US007543583B2

(12) United States Patent
Acton

(10) Patent No.: US 7,543,583 B2
(45) Date of Patent: Jun. 9, 2009

(54) FORCED AIR VENT IN SIDERAIL

(75) Inventor: Troy D. Acton, St. Paul, IN (US)

(73) Assignee: Hill-Rom Services, Inc., Wilmington, DE (US)

( * ) Notice: Subject to any disclaimer, the term of this patent is extended or adjusted under 35 U.S.C. 154(b) by 418 days.

(21) Appl. No.: 11/179,851

(22) Filed: Jul. 12, 2005

(65) Prior Publication Data

US 2006/0053554 A1 Mar. 16, 2006

Related U.S. Application Data

(60) Provisional application No. 60/591,754, filed on Jul. 28, 2004.

(51) Int. Cl.
*A47C 27/08* (2006.01)

(52) U.S. Cl. ..... 128/200.28; 5/423

(58) Field of Classification Search ..... 128/200.28; 545/197, 187, 230, 233; 5/423; 55/385.1, 55/467, 467.1; 607/107
See application file for complete search history.

(56) References Cited

U.S. PATENT DOCUMENTS 3,724,172 A * 4/1973 Wood ..... 95/287
4,140,105 A * 2/1979 Duvlis ..... 128/847
4,559,656 A 12/1985 Foster
4,888,958 A 12/1989 Ella
4,942,635 A 7/1990 Hargest et al.
4,949,413 A 8/1990 Goodwin
4,949,414 A 8/1990 Thomas et al.
4,967,431 A 11/1990 Hargest et al.
5,022,110 A 6/1991 Stroh
5,029,352 A 7/1991 Hargest et al.
5,052,067 A 10/1991 Thomas et al.
5,065,464 A 11/1991 Blanchard et al.
5,095,568 A 3/1992 Thomas et al.
5,272,778 A 12/1993 Gore
5,389,037 A * 2/1995 Hale ..... 454/284
5,453,077 A 9/1995 Donnelly et al.
5,479,666 A * 1/1996 Foster et al. ..... 5/624
5,483,709 A 1/1996 Foster et al.
5,509,155 A 4/1996 Zigarac et al.
5,687,483 A 11/1997 Neubert et al.
5,759,149 A 6/1998 Goldberg et al.
5,817,002 A 10/1998 Donnelly et al.
5,817,003 A 10/1998 Moll et al.
5,971,914 A 10/1999 Donnelly et al.
6,022,310 A 2/2000 Goldberg et al.
6,024,694 A 2/2000 Goldberg et al.
6,036,634 A 3/2000 Goldberg et al.
6,049,924 A 4/2000 Prows et al.
6,158,070 A 12/2000 Bolden et al.
6,270,452 B1 8/2001 Donnelly et al.
6,282,737 B1 9/2001 Vrzalik
6,296,606 B1 10/2001 Goldberg et al.
6,351,862 B1 3/2002 Henley et al.
6,370,718 B1 * 4/2002 Schmid ..... 5/726
6,467,106 B1 10/2002 Heimbrock
6,493,888 B1 12/2002 Salvatini et al.

(Continued)

*Primary Examiner*—Steven O Douglas
(74) *Attorney, Agent, or Firm*—Barnes & Thornburg LLP

(57) ABSTRACT

A patient-support apparatus has a nozzle to provide forced air to the patient. The nozzle is coupled to a siderail or another portion of the patient-support apparatus. The orientation and flow volume of the nozzle is adjustable.

29 Claims, 4 Drawing Sheets

U.S. PATENT DOCUMENTS 6,691,343 B1 2/2004 Goldberg et al.
6,694,557 B1 2/2004 Bobey et al.
6,701,544 B2 3/2004 Heimbrock
6,708,352 B2 3/2004 Salvatini et al.
6,709,384 B1 3/2004 Donnelly et al.
6,719,623 B1 * 4/2004 Kodaveridan et al. ..... 454/76
6,746,394 B2 6/2004 Donnelly et al.
6,761,682 B2 7/2004 Goldberg et al.
6,820,292 B2 11/2004 Heimbrock
6,855,158 B2 2/2005 Stolpmann
7,037,188 B2 * 5/2006 Schmid et al. ..... 454/187
2001/0029628 A1 10/2001 Ferrand et al.
2002/0059679 A1 5/2002 Weismiller et al.
2002/0083529 A1 7/2002 Henley et al.
2003/0073293 A1 4/2003 Ferro et al.
2003/0196271 A1 10/2003 Henley et al.
2004/0034936 A1 2/2004 Welling et al.
2004/0172764 A1 9/2004 Henley et al.
2004/0177450 A1 9/2004 Salvatini et al.
2005/0091753 A1 5/2005 Salvatini et al.

* cited by examiner

FORCED AIR VENT IN SIDERAIL

This application claims priority under 35 U.S.C. § 119(e) to U.S. Provisional Application Ser. No. 60/591,754, filed Jul. 28, 2004, which is expressly incorporated by reference herein.

BACKGROUND

The present disclosure relates to patient-support apparatuses such as hospital beds. More particularly, the present disclosure relates to siderails of hospital beds.

Healthcare facilities, such as hospitals and nursing homes, utilize environmental controls on a broad basis. Environmental controls such as heating and air conditioning systems operate on a room by room or unit by unit basis with no provision for the individual comfort of a particular patient. This leads to patient discomfort which may be addressed through the addition of blankets onto a patient who is uncomfortably cold or the addition of fans within the patient room to provide for increased cooling for a patient who is uncomfortably warm.

SUMMARY

The present invention comprises one or more of the features recited in the appended claims and/or the following features which, alone or in any combination, may comprise patentable subject matter.

A nozzle is provided on a patient-support apparatus to deliver forced air toward an occupant of the patient-support apparatus. The nozzle may be coupled to a siderail or other structure of the patient-support apparatus that is adjacent to the occupant. The structure may be moveable to different positions. The nozzle may be aimed in different directions.

The nozzle may be connected to a source of forced air by means of a conduit. This conduit may be one or more of a hose, tube, valve, manifold or other similar structure which provides for a cavity, void, or path for the forced air to travel from the source of forced air to the nozzle. The source of forced air may be a compressor, a blower, a fan, or other similar air moving device. The present disclosure contemplates that the central gas distribution system typically found in hospitals may be the source of forced air.

The flow volume of the forced air expelled from the nozzle may be adjusted. This adjustment may be accomplished by increasing or decreasing the size of an opening in the nozzle. The flow volume of forced air may also by adjusted by increasing or decreasing the size of the inlet to the source. Additional control of the air flow volume may be accomplished by the adjustment of the speed at which the source of forced air operates.

The air being expelled from the nozzle may be filtered. This filtering may be accomplished by covering the nozzle with a filter, providing a filter at the inlet of the source of forced air, or providing a filter between the source of forced air and the nozzle. Additionally, the air being expelled may be cooled. This cooling may be accomplished by providing a cooling apparatus at the inlet of the source of forced air or providing the cooling apparatus between the source of forced air and the nozzle. The cooling apparatus may be an active cooling apparatus such as a chiller or may be a passive cooling apparatus such as a nozzle. Further, the air being expelled may be heated. This heating may be accomplished by providing a heater at the inlet of the source of forced air or providing a heater between the source of forced air and the nozzle.

The source of forced air may be coupled to a frame of the patient-support apparatus, the siderail, or any other structure of the patient-support apparatus that is adjacent to the mattress such as a headboard, footboard, IV pole, assist bar or other frame mounted accessory. The siderail may be raised and lowered relative to the frame between use and storage positions, respectively. The siderail may have user inputs for controlling the nozzle, the source of forced air, other functions of the patient-support apparatus, and/or other devices in the patient environment. The present disclosure also contemplates the use of a dedicated support structure which is coupled to another portion of the patient support apparatus and moveable to different positions as desired to direct the flow of forced air for a particular patient.

Additional features, which alone or in combination with any other feature(s), including those listed above and those listed in the claims, may comprise patentable subject matter and will become apparent to those skilled in the art upon consideration of the following detailed description of illustrative embodiments exemplifying the best mode of carrying out the invention as presently perceived.

BRIEF DESCRIPTION OF THE DRAWINGS

The detailed description particularly refers to the accompanying figures in which.

DETAILED DESCRIPTION

Figure 1:
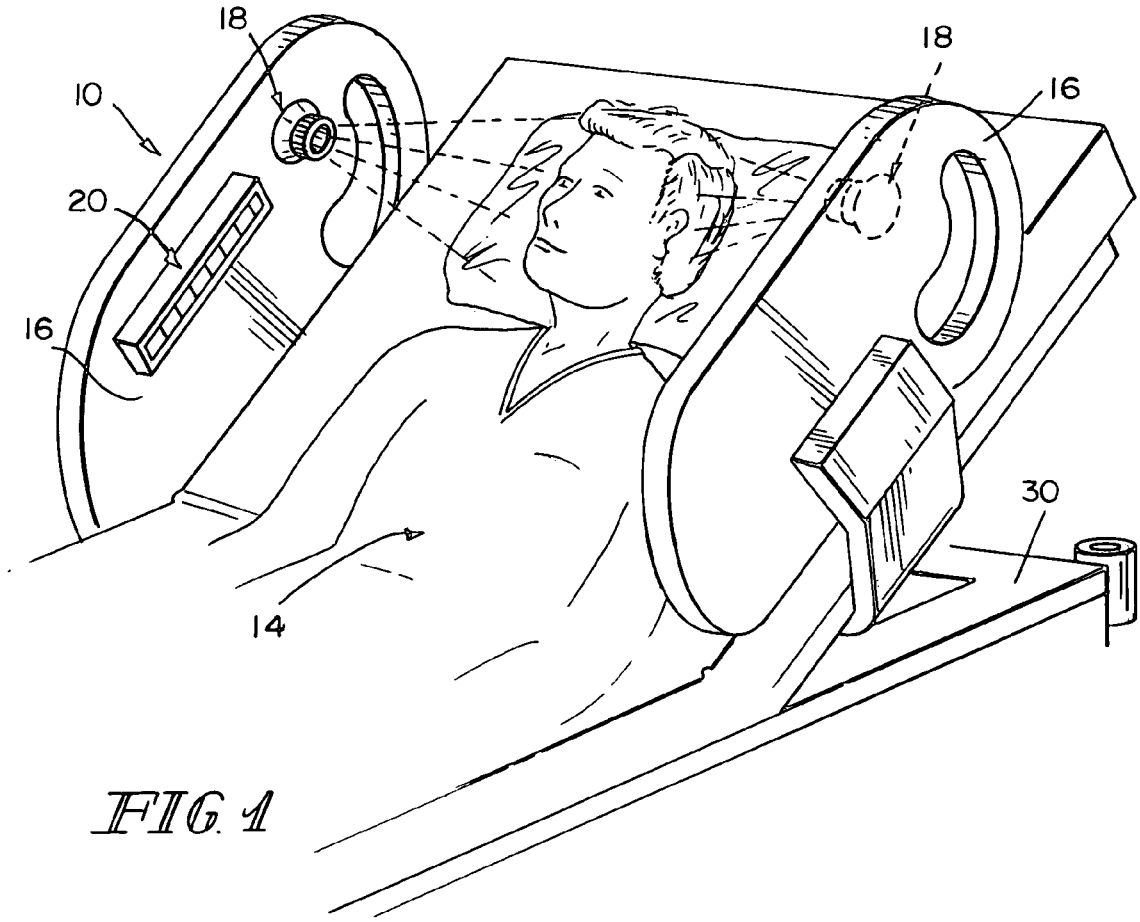
FIG. 1 is a perspective view showing a patient-support apparatus with a siderail having a forced air nozzle which directs forced air toward a patient on a mattress of the patient-support apparatus.

Referring to FIG. 1 and in accordance with the present disclosure, a nozzle 18 is provided to direct forced air toward a patient 14 on a patient-support apparatus 10 such as a hospital bed. Nozzle 18 is coupled to a siderail 16 in the illustrative embodiment of FIG. 1. Siderail 16 is coupled to a frame 30 of patient-support apparatus 10 and is adjacent to a mattress 12 that is supported by frame 30. When not in use, siderail 16 is moved from the raised position, shown in FIG. 1, to a lowered position (not shown) below the mattress surface 60. In the illustrative embodiment, nozzle 18 is adjustable to alter the direction of the flow of forced air.

Figure 2:
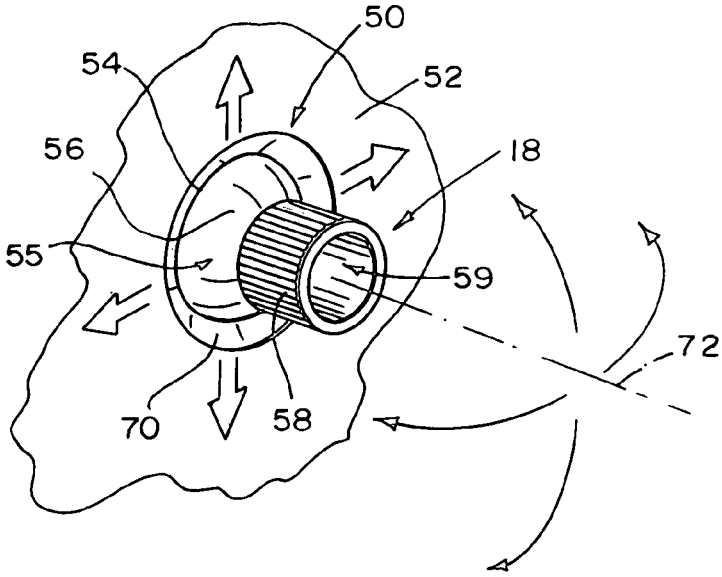
FIG. 2 is an enlarged perspective view of the forced air nozzle of FIG. 1.

Siderail 16 comprises a cavity 50 configured to receive a spherical portion 55 of nozzle 18 as shown in FIG. 2. Cavity 50 comprises a concave spherical surface (not shown) on the interior of a wall 52 of siderail 16. The spherical surface terminates at an aperture 54 through which a portion of nozzle 18 extends. The mating of convex spherical surface 56 to the concave surface on the interior side of wall 52 results in surface contact between the interior of wall 52 and convex spherical surface 56. Convex spherical surface 56 is sized to mate with the concave spherical surface on the interior side of wall 52 with a slight friction fit therebetween so that nozzle 18 remains stationary in any desired position within its range of movement, but so that a user can overcome the friction fit to reposition nozzle 18 as desired. Nozzle 18 further comprises a cylindrical tube 58 coupled to convex spherical surface 18.

A passage 59 through tube 58 communicates with a passage (not shown) through spherical portion 55 to create a flow path through nozzle 18 for forced air to be expelled generally along an axis 72. As convex spherical surface 18 slides on the concave spherical surface on the interior of siderail wall 52, the orientation of nozzle 18 is aimed in a plurality of directions. A countersink 70 is formed on the exterior of siderail wall 52 which provides clearance for tube 58 thereby increasing the range of motion of nozzle 18 providing a larger envelope of orientation of the flow of forced air. Tube 58 can be rotated about axis 72 relative to spherical portion 55 to move components inside of nozzle 18 to adjust the size of an orifice internal to tube 58 and/or portion 55 thereby adjusting the flow volume of air expelled from nozzle 18. In other embodiments, the concave spherical surface or other structure which mates with spherical surface 56 is provided by a separate piece that attaches to wall 52 of siderail 16.

Siderail 16 further comprises a control 20 which is accessible by the patient to control functions of patient-support apparatus 10 such as head elevation, knee elevation, or apparatus height. In some embodiments, control 20 also adjusts other devices in the patient environment such as lighting, television, or radio. Portions of control 20 are used to adjust nozzle 18, such as adjustments in orientation and flow volume of forced air from nozzle 18. Alteration of orientation of nozzle 18 is accomplished by an electromechanical actuator (not shown) to direct the flow of forced air. In another embodiment, the position and orientation of nozzle 18 is altered manually by either patient 14 or a caregiver. While the disclosed embodiment utilizes an electromechanical actuator, those skilled in the art will appreciate that other types of actuators, such as pneumatic or hydraulic actuators, may be employed within the scope of this disclosure.

Figure 6:
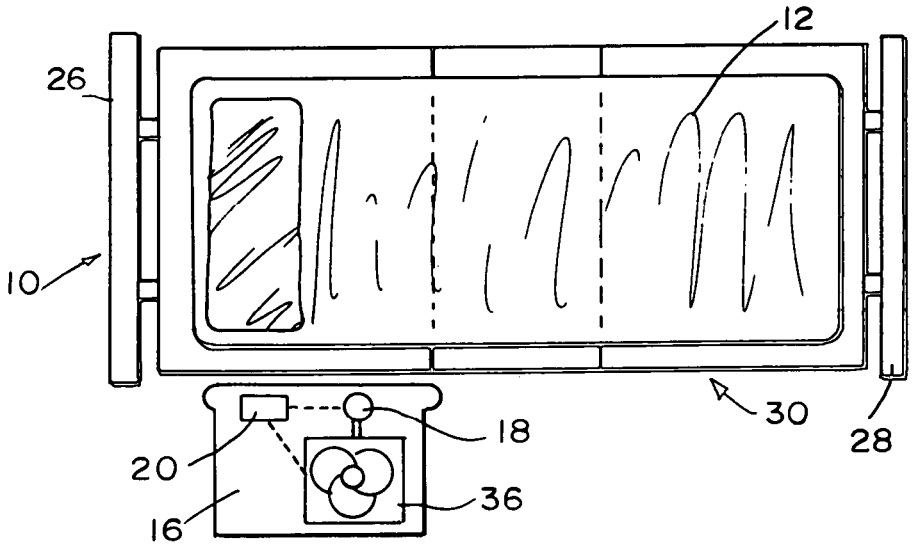
FIG. 6 is a diagrammatic view of a patient-support apparatus with a siderail having a forced air nozzle which directs forced air toward a mattress of the patient-support apparatus and having a source of forced air coupled to the siderail.

FIG. 6 shows a diagrammatic representation of a patient-support apparatus 110 having a source of forced air 36 coupled to siderail 16 and connected to nozzle 18. Control 20 is also coupled to siderail 16 and connected to nozzle 18. In this embodiment, source of forced air 36 receives power from patient-support apparatus 10 and operates as an integral portion of patient-support apparatus 10. Source of forced air 36 is a compressor in some embodiments. In another embodiment, source of forced air is a blower. In still another embodiment, the source of forced air 36 is a fan. Control 20 connected to nozzle 18 provides patient 14 the ability to alter the direction of nozzle 18. In the FIG. 6 embodiment, control 20 is also connected to source of forced air 36 and permits patient 14 to control the flow volume of forced air from source of forced air 36. Inputs to control 20 effect the alteration of the size of an opening at the inlet of source of forced air 36. This changes the amount of air available to source of forced air 36 and thereby varies the flow volume of forced air to nozzle 18. In still another embodiment, the flow volume of forced air is controlled by altering the operating speed of source of forced air 36. As the speed of source of forced air 36 is altered, the flow volume of forced air is altered. As the speed increases, the flow volume increases. As the speed decreases, the flow volume decreases. The speed is controlled through typical motor control methods such as voltage or current regulation.

Figure 5:
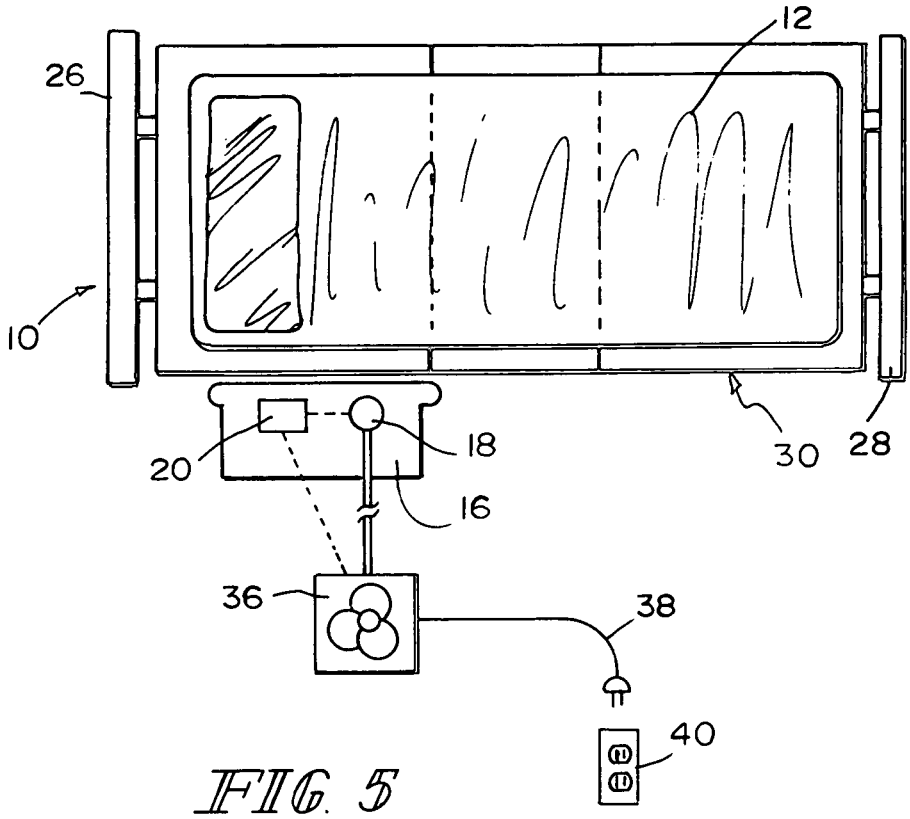
FIG. 5 is a diagrammatic view of a siderail of a patient-support apparatus having a forced air nozzle which directs forced air toward a mattress of the patient-support apparatus, a stand-alone source of forced air spaced from the patient-support apparatus, and a hose extending between the stand-alone forced air source and the siderail.

FIG. 5 is a diagrammatic representation of another embodiment where source of forced air 36 is an independent or stand-alone apparatus connected to nozzle 18 and in communication with control 20. Source of forced air 36 comprises a power cord 38 which is connected to a power outlet 40 to retrieve power therefrom. The FIG. 5 embodiment permits source of forced air 36 to be located away from patient-support apparatus 10 so that noise and heat dissipation in the region near patient 14 is minimized. The connection between source of forced air 36 and nozzle 18 is a conduit 32. Conduit 32 comprises one or more hoses, but pipes, tubes, or other structures having flow passages for directing the flow of forced air may be used. In the FIG. 5 embodiment, control 20 operates similarly to other embodiments described above where control 20 is used to adjust nozzle 18. The adjustments include control of the orientation and flow volume of forced air onto patient 14.

Figure 3:
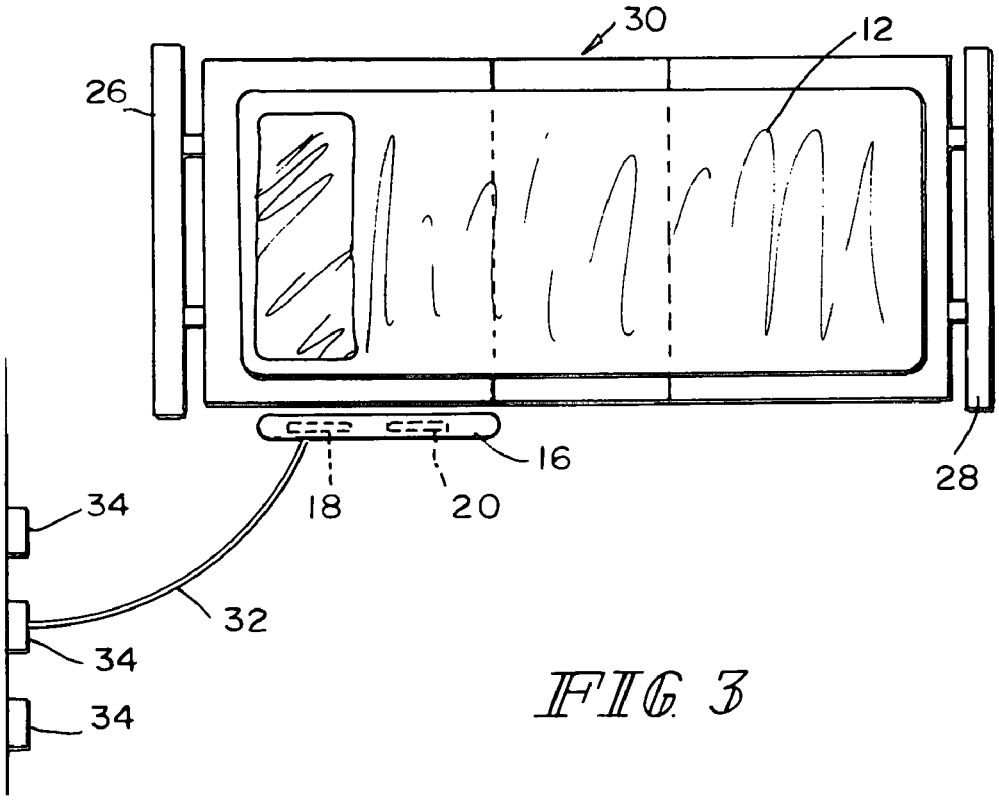
FIG. 3 is a diagrammatic view of a patient-support apparatus with a siderail having a forced air nozzle coupled to a gas service outlet in a wall by a hose.

FIG. 3 shows still another embodiment wherein nozzle 18 is coupled to a gas service outlet 34 typically found in hospital rooms. Gas service outlet 34 typically delivers compressed air, nitrogen, vacuum, or oxygen to the room as appropriate for various medical care requirements. Gas service outlet 34 is coupled to nozzle 18 by conduit 32. Conduit 32 comprises one or more hoses, but pipes, tubes, or other structure having flow passages suitable for directing the flow of forced air may be used. Routing of conduit 32 includes coupling to frame 30 to minimize clutter in the patient room. In other embodiments, routing of conduit 32 utilizes covers and members of frame 30 to achieve an aesthetically pleasing routing of conduit 32.

Figure 4:
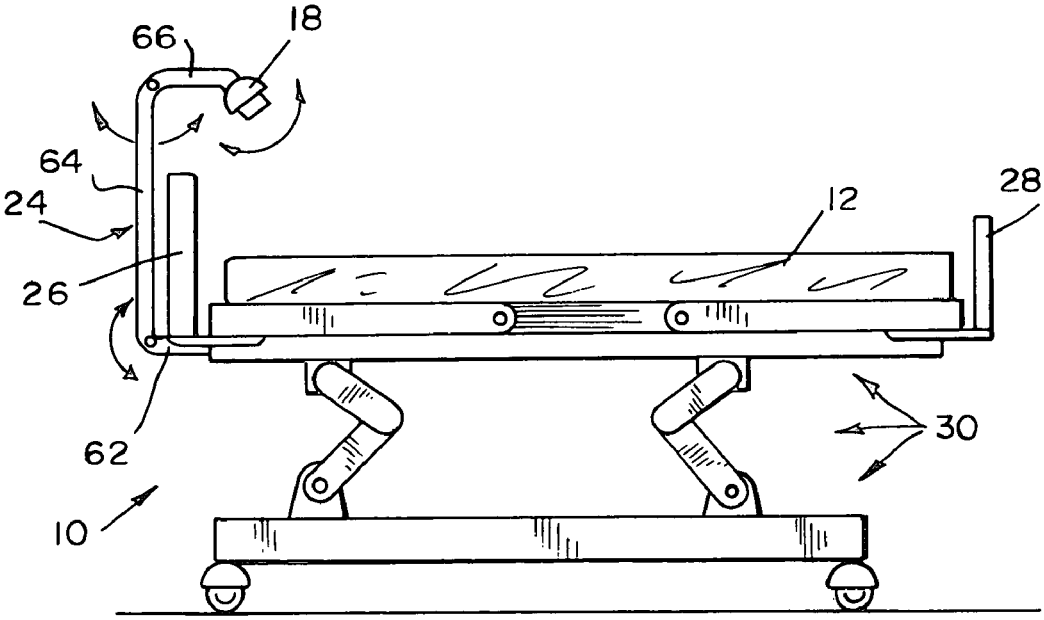
FIG. 4 is a diagrammatic view of a patient-support apparatus with an articulated arm structure having a forced air nozzle which directs forced air toward a patient surface of the patient-support apparatus.

In some embodiments, nozzle 18 is coupled to a structure other than siderail 16. One alternative is to employ an independent structure 24 dedicated to the mounting of nozzle 18 as in FIG. 4. Structure 24 is coupled to patient-support apparatus 10. Structure 24 is positionable such that nozzle 18 is located in a plurality of positions. Structure 24 comprises a first member 62 which is coupled to frame 30 of patient-support apparatus 10. A second member 64 is movably coupled to first member 62 and third member 66 is movably coupled to second member 64. A nozzle 68 is coupled to third member 66 and can be aimed in a plurality of directions. Nozzle 68 is connected by conduit 32 to a source of forced air 36. Source of forced air 36 is a compressor located on frame 30 of patient-support apparatus 10. Conduit 32 is routed alongside first member 62, second member 64, third member 66 and frame 30 to source of forced air 36. In other embodiments, conduit 32 is routed through structure 24, covers, and members of frame 30 to which shields portions of conduit 32 from view. In some embodiments, source of forced air 36 may be a blower, a fan, a gas service outlet 34, or other suitable apparatus.

In another embodiment, conduit 32 is omitted and forced air is routed to nozzle 68 through flow passages in members 62, 64, 66 of structure 24. In this embodiment, conduit 32 routes forced air from source of forced air 36 to first member 62 but does not extend through or along structure 14. The coupling of first member 62 to second member 64 and second member 64 to third member 66 is configured to provide a substantially air-tight passageway that permits air to flow to nozzle 68 through members 62, 64, 66. For example, the couplings between members 62, 64, 66 may comprise one or more flexible pieces of hose coupled to each member, the hose being flexible so that articulation of the hose as structure 24 is positioned does not compromise the flow of forced air.

In yet another embodiment, conduit 32 is routed through structure 24 in a single piece so as to reduce the number of coupling points in the path of the flow of forced air. In still another embodiment, the combination of structure 24 and conduit 32 is replaced by a flexible gooseneck member (not shown) coupled to frame 30. The flexible gooseneck member has an internal passage through which forced air is routed to nozzle 68 which is coupled to an end of the flexible gooseneck member. The opposite end of flexible gooseneck member is coupled to frame 30 and connected through conduit 32 to source of forced air 36.

Nozzle 68 may be coupled directly to any suitable structure found on patient-support equipment such as a headboard 26, a footboard 28, an IV pole (not shown), an assist bar (not shown), or other similar structure known to be found on patient-support apparatus 10. In such embodiments, nozzle 68 is connected by way of conduit 32 to source of forced air 36.

Figure 7:
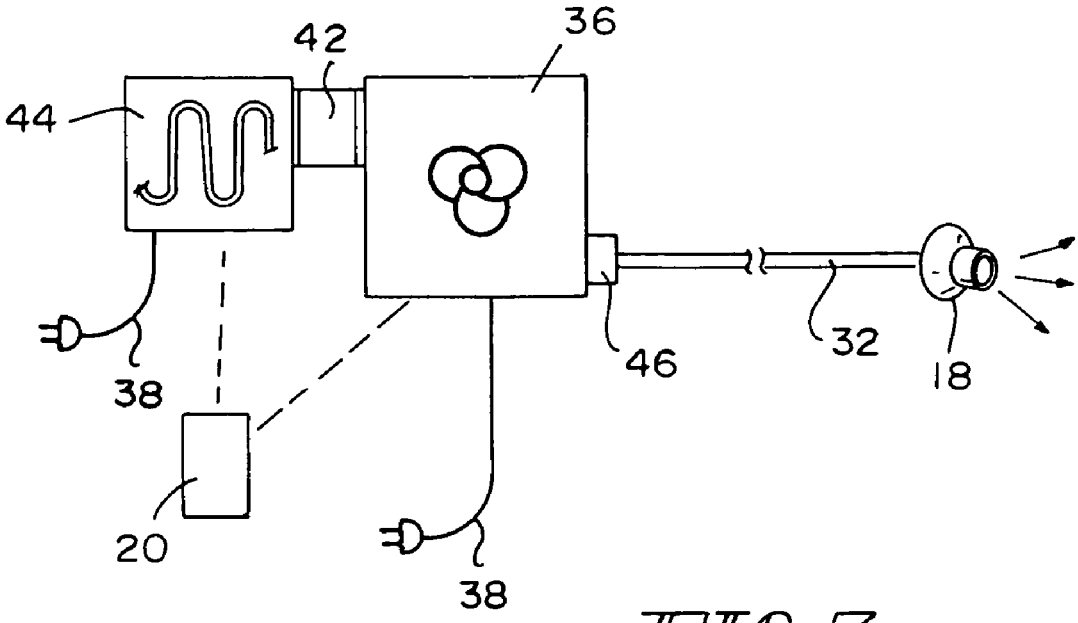
FIG. 7 is a diagrammatic view of a source of forced air with an inlet and an exit having a temperature control apparatus coupled to the inlet.

In FIG. 7, an independent source of forced air 36 comprises an inlet 42, an outlet 46, and a power cord 38. The source of forced air 36 is connected to a control 20 which controls the speed of source forced air 36, thereby adjusting the flow volume of forced air. Coupled to inlet 42 is a temperature control apparatus 44. Temperature control apparatus 44 also has a power cord 38 and is in communication with control 20. In this embodiment, temperature control apparatus 44 operates as a chiller. As air is drawn through temperature control apparatus 44 into inlet 42, the air is cooled. The cooled air is moved by source of forced air 36 through exit 46 and conduit 32 being expelled at nozzle 18. Patient 14 or a caregiver can alter the operating parameters of temperature control apparatus 44.

In another embodiment, temperature control apparatus 44 is a heater which heats the air expelled at nozzle 18. While the diagrammatic illustration at FIG. 7 shows temperature control apparatus 44 coupled to an independent source of forced air 36, those skilled in the art will recognize that temperature control apparatus 44 can be easily applied to other configurations of sources of forced air 36 or at other points along the flow path of the forced air. For example, in another embodiment, temperature control apparatus 44 is integrated into the source of forced air 36 such that the air is heated as it is moved by the source of forced air 36. In yet another embodiment, temperature control apparatus 44 is placed between source of forced air 36 and the nozzle 18 so that temperature control apparatus 44 changes the air temperature as the air passes through conduit 32. In still another embodiment, temperature control apparatus 44 is coupled to nozzle 18 such that air temperature is changed as it exhausts from nozzle 18. In some embodiments, temperature control apparatus 44 may comprise both a heater and a cooler.

Figure 8:
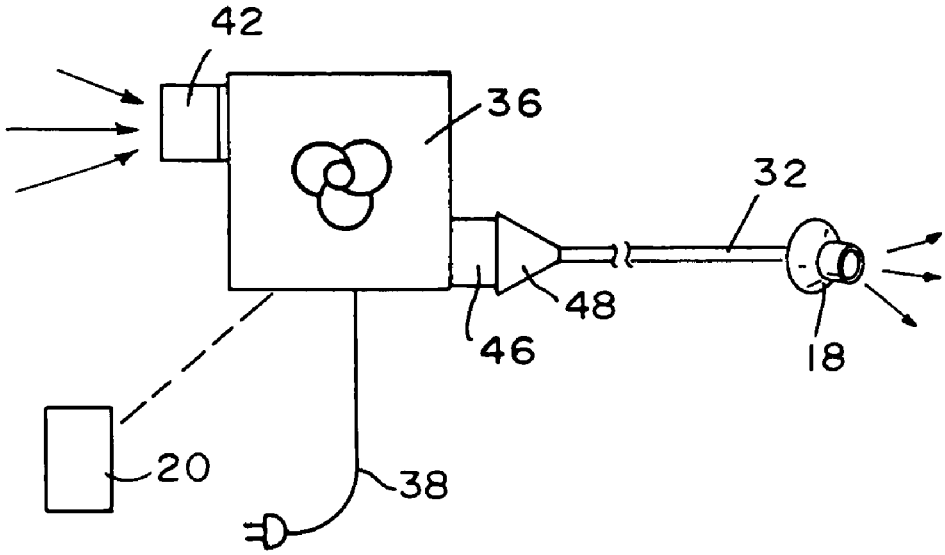
FIG. 8 is a diagrammatic view of a source of forced air with an inlet and an exit having a filter coupled to the exit.

In FIG. 8, an independent source of forced air 36 comprises an inlet 42, an outlet 46, and a power cord 38. The source of forced air 36 is connected to a control 20 which controls the speed of source forced air 36, thereby adjusting the flow volume of forced air. Coupled to exit 46 is a filter 48. Filter 48 serves to filter the air being delivered from nozzle 18 to reduce the potential for irritation for patient 14. Filter 48 is removable and/or replaceable as it becomes contaminated from excess filtered material. While the diagrammatic illustration at FIG. 8 shows filter 48 coupled to an inlet 42 of independent source of forced air 36, those skilled in the art will recognize that filter 48 can be easily applied to other configurations of sources of forced air 36 or at other points along the flow path of the forced air. For example, in a different embodiment filter 48 is coupled to the inlet 42 of source of forced air 36 such that the air is cleaned as it is drawn in by the source of forced air 36. In yet another embodiment, filter 48 is placed between source of forced air 36 and nozzle 18 so that filter 48 cleans the air as the air passes through conduit 32. In still another embodiment, the filter 48 is coupled to nozzle 18 such that the air is cleaned as it exhausts from nozzle 18.

Although certain illustrative embodiments have been described in detail above, variations and modifications exist within the scope and spirit of this disclosure as described and as defined in the following claims.

The invention claimed is:

1. A siderail of a patient-support apparatus, the siderail comprising a main siderail portion including a cavity there within and a nozzle integrated into the main siderail portion such that the nozzle is an essential element of the main siderail portion, at least a portion of the nozzle being positioned within the cavity, the nozzle being configured to expel air toward a patient on the patient-support apparatus.

2. The siderail of claim 1, wherein the nozzle is moveable with respect to the siderail to a plurality of orientations along a curved path.

3. The siderail of claim 1, wherein the nozzle provides for the adjustment of the air flow volume.

4. The siderail of claim 1, further comprising a filter to filter the air being expelled.

5. The siderail of claim 1, further comprising a temperature control apparatus to cool the air being expelled.

6. The siderail of claim 1, further comprising a temperature control apparatus to heat the air being expelled.

7. The siderail of claim 1, wherein a source of air is coupled to the patient-support apparatus.

8. The siderail of claim 1, wherein a source of air is coupled to the siderail.

9. The siderail of claim 1, wherein the siderail further comprises user inputs that are used to control functions of the patient-support apparatus.

10. A patient-support apparatus comprising a frame adapted to support a patient thereon, a first structure coupled with the frame and configured to define at least a portion of a perimeter barrier, a second structure including a first portion coupled to the frame and a second portion positioned adjacent the patient, the second portion including a cavity therein, and a nozzle integrated into the second portion of the second structure such that the nozzle is an essential element of the second structure, at least a portion of the nozzle being positioned within the cavity, the nozzle being configured to expel air toward the patient on the patient-support apparatus.

11. The patient-support apparatus of claim 10, wherein the nozzle provides for the adjustment of the air flow volume.

12. The patient-support apparatus of claim 10, further comprising a filter to filter the air being expelled.

13. The patient-support apparatus of claim 10, further comprising a temperature control apparatus to cool the air being expelled.

14. The patient-support apparatus of claim 10, further comprising a temperature control apparatus to heat the air being expelled.

15. The patient-support apparatus of claim 10, wherein the source of air is coupled to the second structure.

16. The patient-support apparatus of claim 10, wherein the source of air is coupled to the patient-support apparatus.

17. An apparatus for providing air to a patient on a patient-support, the apparatus comprising a source of air including an inlet and an outlet, the source of air providing a flow of air, a filter coupled to the source of air, a temperature control apparatus in communication with the flow of air, a conduit configured to conduct the flow of air, and an adjustable nozzle coupled to the patient-support and in communication with the conduit, the adjustable nozzle being adapted to move along a curved path with respect to the patient-support to a plurality of orientations and configured to direct the flow of air toward a patient supported on the patient-support.

18. The apparatus of claim 17 wherein the filter is coupled to the inlet of the source of air.

19. The apparatus of claim 17 wherein the temperature control apparatus is a chiller.

20. The siderail of claim 1, wherein the siderail is movable between a raised position and a lowered position.

21. The siderail of claim 1, wherein the nozzle protrudes from the main siderail portion.

22. The siderail of claim 1, wherein the nozzle includes a curved portion that is adapted to interface with the main siderail portion, the curved portion cooperates with the main siderail portion to move the nozzle with respect to the main siderail portion along a curved path.

23. The siderail of claim 1, wherein the main siderail portion includes an opening that defines a plane, the nozzle moving with respect to the main siderail portion along a curved path having a center of curvature located a predetermined distance from the plane.

24. The patient-support apparatus of claim 10, wherein the nozzle includes a curved portion adapted to interface with the second portion of the second structure, the curved portion cooperating with the second portion of the second structure to move the nozzle to a plurality of orientations with respect to the second structure.

25. The patient-support apparatus of claim 10, wherein the nozzle is adapted to move with respect to the second structure to a plurality of orientations along a curved path.

26. The patient-support apparatus of claim 10, wherein the nozzle protrudes from the second portion of the second structure.

27. The patient-support apparatus of claim 10, wherein the second structure includes an opening that defines a plane, the nozzle moving with respect to the second structure along a curved path having a center of curvature located a predetermined distance from the plane.

28. The apparatus of claim 17, wherein the nozzle includes a curved portion that is adapted to interface with the patient-support, the curved portion cooperates with the patient- support to move the nozzle with respect to the patient-supp oil along a curved path.

29. The apparatus of claim 17, wherein the nozzle includes a base portion coupled to the patient-support and a protruding portion that protrudes from the patient-support.

* * * * *